US007056198B2

(12) United States Patent
Smith

(10) Patent No.: US 7,056,198 B2
(45) Date of Patent: Jun. 6, 2006

(54) DUST CONTAINMENT DEVICE FOR SURFACING MACHINES

(75) Inventor: Terrance C. Smith, Bellevue, WA (US)

(73) Assignee: Harris Research, Inc., Logan, UT (US)

( * ) Notice: Subject to any disclaimer, the term of this patent is extended or adjusted under 35 U.S.C. 154(b) by 77 days.

(21) Appl. No.: 10/867,196

(22) Filed: Jun. 14, 2004

(65) Prior Publication Data

US 2005/0277374 A1 Dec. 15, 2005

(51) Int. Cl.
*B24B 23/00* (2006.01)

(52) U.S. Cl. ..... 451/350; 451/451; 451/456

(58) Field of Classification Search ..... 451/350, 451/351, 352, 358, 451, 456, 453, 457
See application file for complete search history.

(56) References Cited

U.S. PATENT DOCUMENTS

| | | | | |
|---|---|---|---|---|
| 2,801,437 | A * | 8/1957 | Okun | 15/325 |
| 4,381,628 | A | 5/1983 | Dicke | 51/170 TL |
| 5,363,600 | A * | 11/1994 | Shishido et al. | 451/397 |
| 5,388,305 | A * | 2/1995 | Fields | 15/385 |
| 5,711,051 | A | 1/1998 | Roden | 15/321 |
| 5,974,626 | A | 11/1999 | Wood et al. | 15/385 |
| 6,216,312 | B1 * | 4/2001 | Rowan | 15/321 |
| RE37,162 | E | 5/2001 | Roden | 15/321 |
| 6,240,596 | B1 | 6/2001 | Kiern | 15/385 |

* cited by examiner

*Primary Examiner*—Dung Van Nguyen
(74) *Attorney, Agent, or Firm*—Starkweather & Associates; Michael W. Starkweather; Jason P. Webb

(57) ABSTRACT

A floor machine comprising a motor, a body, and a dust collection system. The dust collection system comprises a skirt, which is coupled to the floor machine and forms a cavity over the body and a floor treatment pad. The skirt includes an air channel device secured to a bottom edge of the skirt. The air channel device encircles the floor treatment pad and comprises a multiplicity of slots between a floor and the skirt. Jointly, the skirt and air channel device confine particles within the cavity. A vacuum for sucking the particles from the cavity creates high velocity air flow through the air channel device. Negative pressure within the cavity prevents particles from escaping. The particles are removed from the cavity through a vacuum tube into the vacuum.

20 Claims, 5 Drawing Sheets

DUST CONTAINMENT DEVICE FOR SURFACING MACHINES

BACKGROUND OF THE INVENTION

1. The Field of the Invention

The present invention relates to surfacing machines. More particularly, the present invention relates to a device for dust containment for surfacing machines.

2. The Background Art

High speed burnishing is a floor polishing method using a very fine abrasive disc rotating at 1000 RPM's or more to produce a high "wet look" glass appearance on the floor. Typically a high solids content floor finish material is spread in a thin layer on the floor, allowed to harden, and then burnished with a high RPM burnishing machine. The burnishing process removes the top particles of the floor finish with the fine abrasive rotating disc, producing a smooth glossy appearance. In the process, the top layer of floor finish is removed in the form of a very fine powder. In addition to this powder, the burnishing pad itself wears down and discharges pad particles. This powder and worn pad material often become airborne because of the air turbulence created by the high speed rotation of the disc. This airborne material is undesirable because the powder, material, and dust then settle back onto the floor and on furniture and must be removed with a dust mop, vacuum cleaner, or similar means.

Further, the dust that is liberated is particularly noxious. Typically, it is of extremely small particle size—slightly larger than one micron—and is centrifugally thrown outward of the buffer during the high speed buffing operation.

Left uncontrolled, this dust liberation presents a serious problem. Floating particles of wood, solvent, water base floor finish, paint, lacquer, and dirt constitute a potentially serious health hazard to children and adults due to the possibility of inhalation.

To reduce the need to dust mop after using the polishing machine, prior floor polishing machines included dust collection systems of various forms. Some dust collection systems use a shroud for trapping the dirt or dust and others use fully integrated permeable walls to trap dirt or dust and a vacuum to suck the dirt or dust. However, each of these collection systems is deficient in various respects in assembly, universal use, adaptability, retrofitting, economies, operation, and effective collection. For example, some of these collection systems do not deform to match inconsistencies on the floor. Likewise, some of these collection systems inhibit the polisher from reaching all areas of the floor due to the shape of the collection system or the placement of vacuum tubes. Additionally, some of these collection systems are not universal to many types of collection systems, and most, if not all, may not be added to existing, older, models of polishers.

Thus, a need continues for a dust containment device for surfacing machines that may be configured for use with all types of surfacing machines and that does not inhibit a surfacing machine from reaching all areas of the floor.

SUMMARY OF THE INVENTION

The present invention has been developed in response to the present state of the art, and in particular, in response to the problems and needs in the art that have not yet been fully solved by currently available dust containment device for surfacing machines. Accordingly, the present invention has been developed to provide an improved dust containment device for surfacing machines.

More specifically, one feature of the present invention relates to a surfacing machine comprising a motor, a body, and a dust containment device. The dust containment device comprises a skirt, which is coupled to the floor machine and forms a cavity over the body and a floor treatment pad. The skirt includes an air channel device secured to a bottom edge of the skirt. The air channel device encircles the floor treatment pad and comprises a multiplicity of slots between a floor and the skirt. Jointly, the skirt and air channel device confine particles within the cavity. A vacuum for sucking the particles from the cavity creates high velocity air flow through the air channel device. Negative pressure within the cavity prevents particles from escaping. The particles are removed from the cavity through a vacuum tube into the vacuum.

Another feature of the present invention provides a containment device that efficiently contains particles created by a surfacing machine within a cavity. Another feature of the present invention provides a skirt that does not inhibit the surfacing machine from accessing work surfaces that would generally be accessible without the skirt. A further feature of the invention provides an air channel device that effectively intensifies air flow from outside the cavity, which increases particle containment and which effectively creates a vacuum within the cavity. A further feature of the invention provides a containment system that may be quickly and easily attached to, and used on, both new and old surfacing machines.

Additional features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE ILLUSTRATED EMBODIMENT(S)

Figure 1:
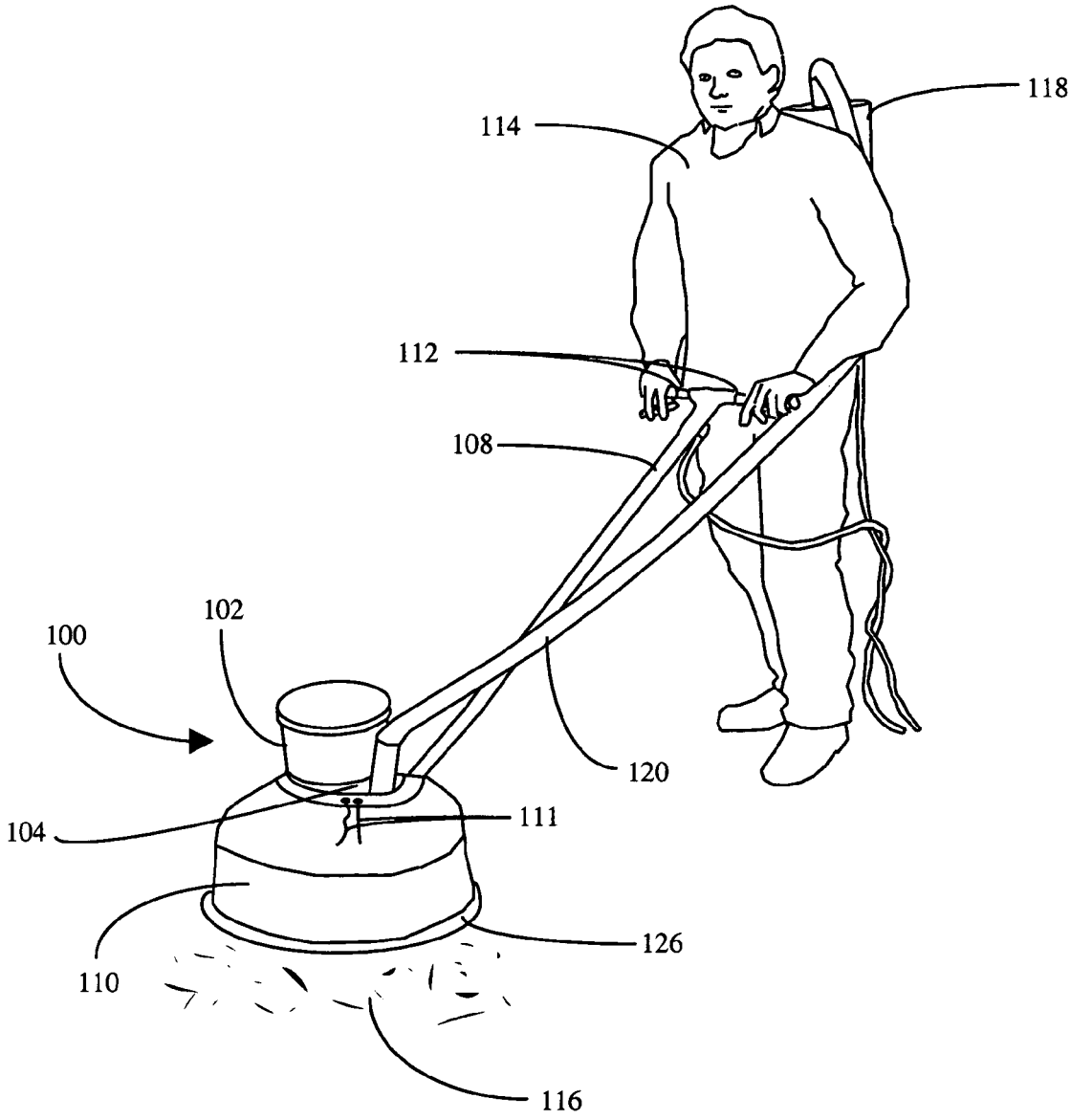
FIG. 1 is a perspective view illustrating one embodiment of a floor machine according to the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one, skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

FIG. 1 is a perspective view of a floor machine 100 according to one embodiment of the present invention. The floor machine 100 comprises a motor 102, which may be mounted on a body 104, and a handle 108 attached to the body 104. In this embodiment, a dust collection device comprises a skirt 110, removably secured to the motor 102 via a drawstring 111 and configured to confine dust particles. An air channel device 126, coupled to a bottom edge of the skirt 110, allows air to flow into an area enclosed by the skirt 110.

In operation, a floor treatment pad is selected depending on the job that is to be performed, and may include, for example, a polishing pad, a stripping pad, a brush, a sand screen, a sanding disk, or other type. Control grips 112 on the handle 108 allow a user 114 to manipulate the floor machine 100 in specific directions. One commercially-available floor machine 100 of this type is the Low Boy® model floor machine available from the Oreck® Corporation of New Orleans, La. The user 114 holds the control grips 112 to start the motor 102. At the user's 114 command, the motor 102 spins the floor treatment pad to perform the cleaning, polishing, sanding, or other desired operation on the work surface 116.

In some cases, such as during sanding of wooden floors, the grinding of the floor treatment pad on the work surface 116 produces a large amount of particulates, such as wood dust. In such a case, a vacuum 118 may be used in conjunction with the floor machine 100. In one embodiment, the vacuum 118 may be coupled to the body 104 of the floor machine 100 via a vacuum hose 120. In the illustrated embodiment, the user 114 wears the vacuum 118 as a "backpack." The vacuum hose 120 and the vacuum 118 remove the particulates (e.g. dirt, debris, wood dust, used floor sealing or floor covering material, etc.) produced by the action of the floor treatment pad. The particulates picked up by the vacuum hose 120 are then stored within the vacuum 118 for later disposal.

Figure 2:
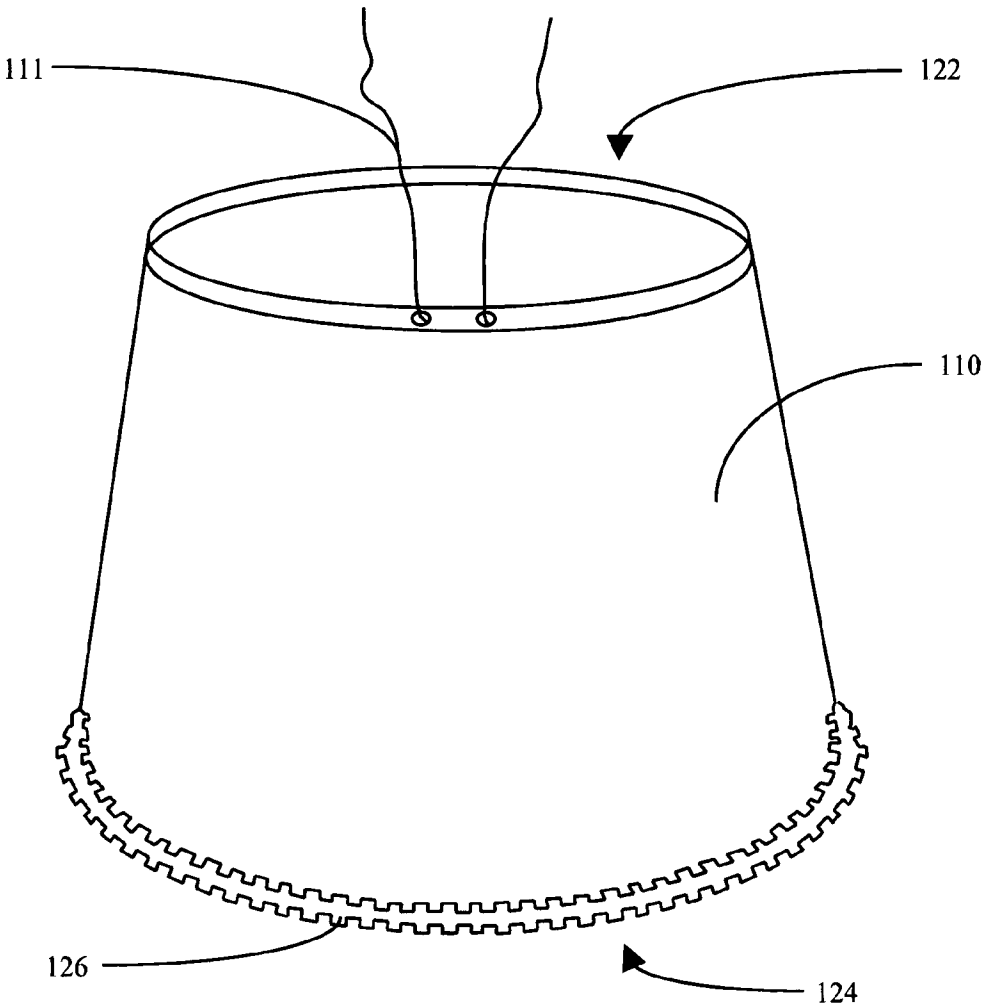
FIG. 2 is a perspective view illustrating one embodiment of a machine skirt according to the present invention.
Figure 3:
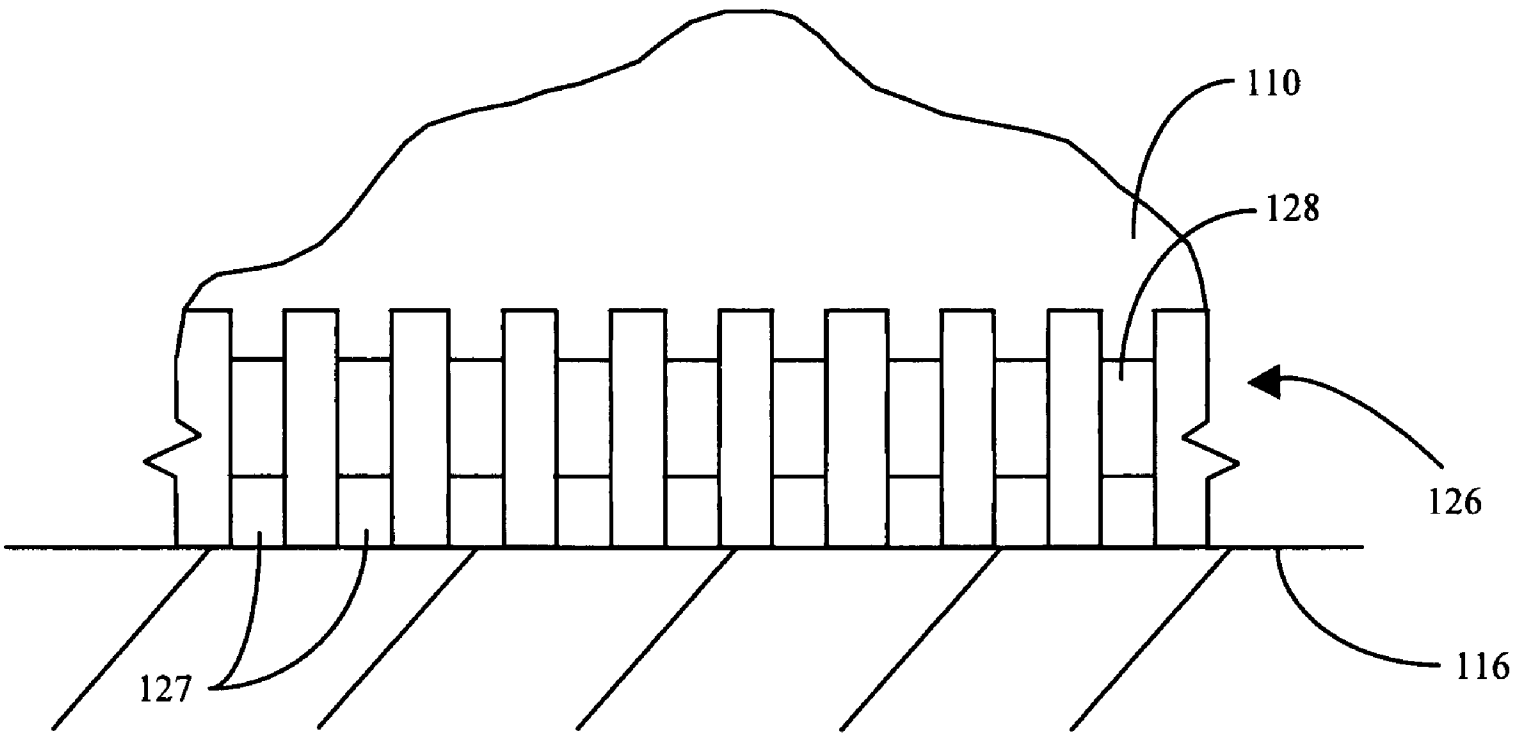
FIG. 3 is an enlarged sectional view illustrating one embodiment of an air channel device according to the present invention.
Figure 4:
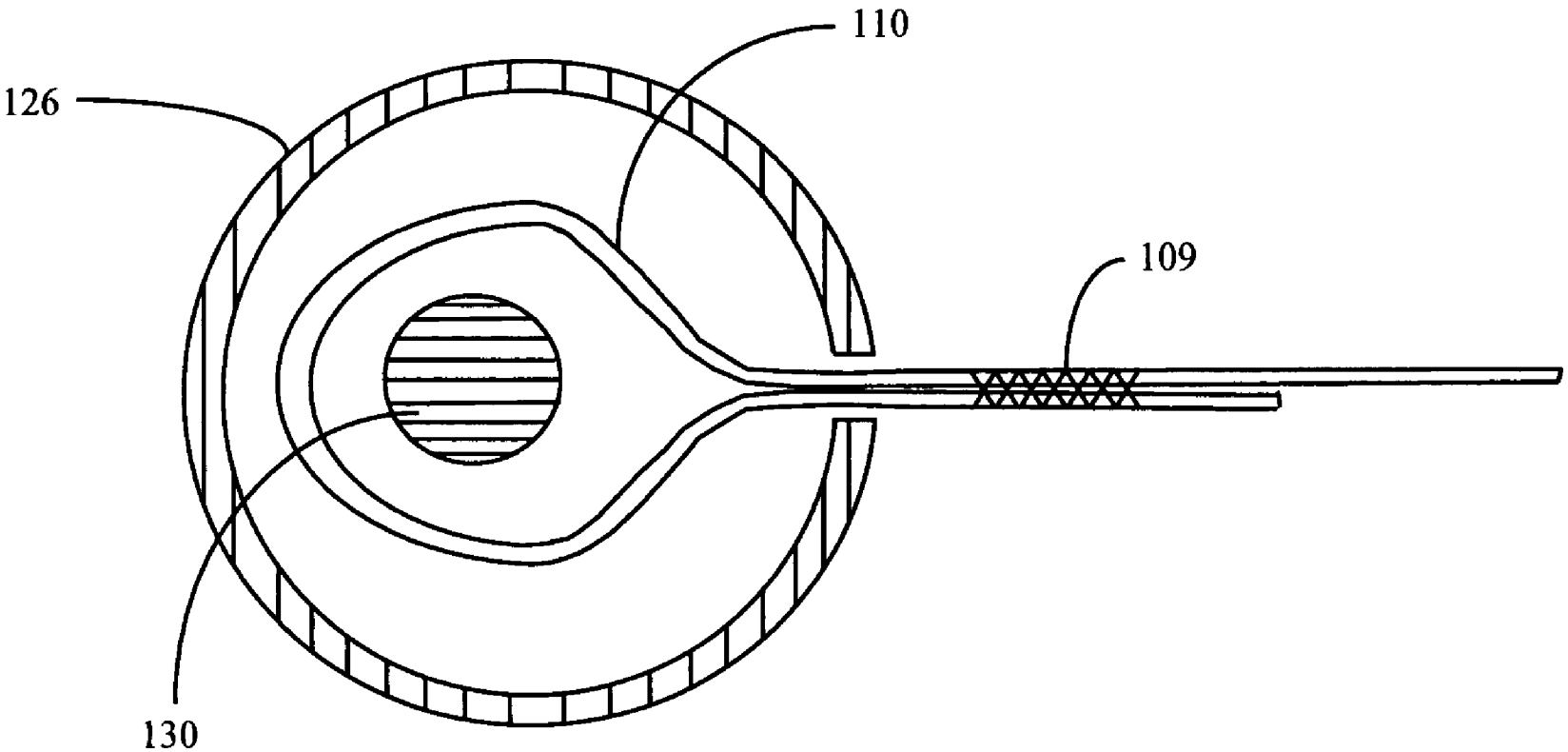
FIG. 4 is a cross-sectional view illustrating one embodiment of a bottom edge of a skirt including an air channel device, a ring, and material.

FIGS. 2, 3, and 4 illustrate another embodiment of a machine skirt 110. In this embodiment, the machine skirt 110 is made of a flexible material. Advantageously, the flexible material allows the bottom edge of the skirt 110 to shift and conform so that the floor machine 100 may still reach into corners, almost as if it did not have the skirt 110 attached. Generally, a large, inflexible skirt 110 would impede access to small areas. As a result, the bottom edge of the skirt 110 may be configured with a larger than average circumference to fit on a multitude of different sized polishing machines 100.

In a preferred embodiment, the skirt 110 is comprised of a substantially impermeable material, such as fabric, rubber, vinyl, etc. The skirt 110 includes a top hole, or loop 122 and a bottom hole, or loop 124. The top hole 122 may be adjustable in circumference to fit different sized motors 102 or body 104 sections. In one embodiment, the circumference of the top hole 122 may adjust via a drawstring; in another embodiment, the circumference of the top hole may adjust via buttons, elasticity, or another securing means. Attached to the motor 102, the skirt 110 forms a cavity around the body 104 of the floor machine 100. The air channel device 126 encircles the bottom edge of the skirt 110 and is configured to accelerate air into the cavity created by the skirt 110.

FIG. 3 is an enlarged sectional view of the machine skirt 110, specifically, the air channel device 126. In this embodiment, the air channel device 126 is constructed of corrugated tubing that is longitudinally split down its entire length to receive the bottom edge of the skirt 110 therein. The air channel device 126 comprises recessed portions 128 forming a multiplicity of slots 127 that increases air suction pressure when the slots 127 contact the floor. The slots 127 may comprise sharp square edges, however, it is envisioned that other shapes may also be appropriate, rounded edges, grooves, holes, venturies, etc. Additionally, it is also envisioned that the size and number of the slots 127 may be increased or decreased depending on the size and suction of the accompanying vacuum 118.

FIG. 4 illustrates a cross-sectional view of another embodiment for the bottom edge of the skirt 110. The skirt 110 may include a ring, or hoop, 130 secured to the bottom edge of the skirt 110 along the periphery of the bottom hole 124. The ring 130 may be sewn into the skirt 110 with stitching 109, or simply secured to the bottom edge. The ring 130 comprises a rigid material, such as iron, aluminum, or plastic. The ring 130 has the purpose of maintaining the skirt's 110 shape, weighing down the bottom edge, and to prevent the skirt 110 from wrapping around the spinning floor treatment pad. In this embodiment, the ring 130 maintains the skirt 110 in a generally circular shape.

In another embodiment, a rail, fence, or screen, is attached to the body 104 or integrated into the skirt 110, and extends downwardly towards the work surface 116, which may also function to prevent the skirt 110 from contacting and wrapping around the floor treatment pad.

Figure 5:
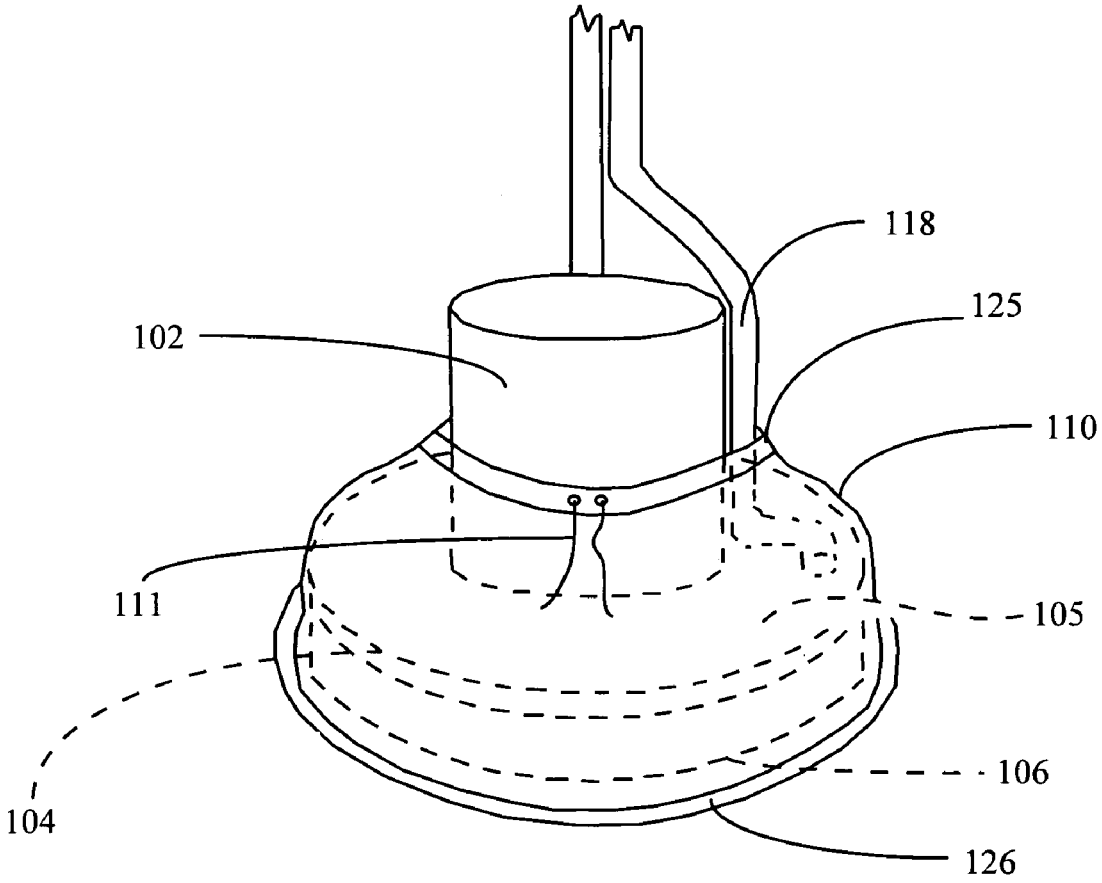
FIG. 5 is a perspective view of one embodiment of a machine skirt fixed to a floor machine from FIG. 1.

FIG. 5 is a perspective view of another embodiment of a machine skirt 110. In particular, the vacuum hose 120 passes between the motor 102 and the top edge, or top portion 125 connected to the skirt 110. The top portion 125 is coupled about the motor 102 above the top 105 of the body 104. In another embodiment, the skirt 110 may include a hose hole for receiving the vacuum hose 120. The hose hole, which may be defined by the top edge, or top portion 125, may be adjustable to form a tight fit around the vacuum hose 120. In either embodiment, the vacuum hose 120 is configured to connect to the body 104 to draw the particles from the cavity. It is also envisioned that the vacuum hose 120 may pass along an edge of the body 104 or simply rest atop the body 104 to draw the particles into the vacuum. There is also an air channel device 126 encircling the bottom edge, or bottom portion of the skirt 110.

It is understood that the above-described arrangements are only illustrative of the application of the principles of the present illustrated embodiments. Numerous modifications and alternative arrangements may be devised by those skilled in the art without departing from the spirit and scope of the present invention and the appended claims are intended to cover such modifications and arrangements.

For example, while the present invention discusses the use of the flexible skirt 110, it is envisioned that the skirt 110 may fit snugly around the motor 102 and body 104 of the floor machine 100. The air channel device 126 would encircle the floor treatment pad 106 and lack the movability associated with the flexible skirt 110 described above. The snug fit around the motor 102 and the body 104 may provide an added benefit of creating an improved suction power from the vacuum 116. Additionally, the snug fit may prevent snags and catches in tight areas. To form the tight fit, the skirt 110 may be comprised of a rubber-type, or plastic-type material, or it may be secured to the floor machine 100 differently to fit more snugly, for example, a zipper may be used.

Additionally, although the present invention teaches that the skirt 110 may be secured to the motor 102 by a draw string, it is envisioned that the skirt may be secured to the motor 102 by any reasonable means, including, but not limited to screws, buckles, tape, and elastic. Additionally, although the skirt 110 may be removable, it is envisioned that the skirt 110 may be permanently affixed to the motor 102 of a floor machine 100 that did not previously have a skirt 110, or the previous skirt 110 had worn out. It is also envisioned that the skirt 110 may be attached to any portion of the floor machine 100.

Additionally, although the specification discusses the use of a backpack type vacuum, it is envisioned that the vacuum is attached directly to the floor machine 100.

Finally, although the specification discusses the use of the skirt 110 on floor surfacing machines 100, it is also envisioned that the skirt 110 may be applied to a variety of other devices. For example, it is envisioned that the skirt 110 may be fastened to a hand-held sanding device and used on other surfaces, such as countertops.

While the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A dust containment device for mounting on a surfacing machine having a motor mounted upon a top of a body having a larger circumference than the motor, comprising:

a top loop having an adjustable circumference, including a maximum circumference and a minimum circumference, wherein the top loop is configured to removably couple about the motor and above the body;

a bottom loop having a circumference greater than the minimum circumference of the top loop, wherein the bottom loop is substantially rigid and configured to encircle about the body, and having a multiplicity of slots proximate the work surface; and a substantially flexible skirt coupled between the top and bottom loops, and configured to cover a substantial portion of the top of the body of the surfacing machine.

2. The device according to claim 1, wherein the device is substantially impermeable to air.

3. The device according to claim 2, wherein the circumference of the top loop is adjustable by means of an adjuster selected from the group consisting of a drawstring, buckle, tape, elastic, and a button.

4. The device according to claim 1, wherein the multiplicity of slots each comprise sharp squared edges.

5. The device according to claim 4, wherein the top loop is configured to allow access by a vacuum hose to a cavity defined by the body.

6. The device according to claim 5, wherein the multiplicity of slots are formed by corrugated tubing.

7. The device of claim 6, further comprising a ring of rigid material secured to a bottom edge of the skirt and enclosed within the corrugated tubing.

8. The device of claim 5, wherein the skirt is substantially impermeable to air.

9. The device of claim 8, wherein the bottom loop further comprises a ring of rigid material secured to a bottom edge of the skirt.

10. The device of claim 4, wherein the circumference of the top loop is adjustable by means of a drawstring.

11. A dust containment system for surface machines, comprising:

a surfacing machine having a motor mounted upon a top of a body having a larger circumference than the motor; and a dust containment device mounted upon the top of the body, including:

a top loop having an adjustable circumference including a maximum circumference and a minimum circumference, wherein the top loop is configured to removably couple about the motor and above the body;

a bottom loop having a circumference greater than the minimum circumference of the top loop, wherein the bottom loop is substantially rigid and configured to encircle about the body, and having a multiplicity of slots proximate the work surface; and a substantially flexible skirt coupled between the top and bottom loops, and configured to cover a substantial portion of the top of the body of the surfacing machine.

12. The system of claim 11, wherein the device is substantially impermeable to air.

13. The system according to claim 12, wherein the circumference of the top loop is adjustable by means of an adjuster selected from the group consisting of a drawstring, buckle, tape, elastic, and a button.

14. The system according to claim 11, wherein the substantially flexible skirt further comprises a hose hole configured to receive a vacuum hose.

15. The system according to claim 14, wherein top loop is configured to allow access by a vacuum hose to a cavity formed by the skirt.

16. The system according to claim 15, wherein the multiplicity of slots are formed by corrugated tubing.

17. The system of claim 15, wherein the skirt is substantially impermeable to air.

18. The system of claim 17, wherein the bottom loop further comprises a ring of rigid material secured to a bottom edge of the skirt.

19. The system of claim 14, wherein the circumference of the top loop is adjustable by means of a drawstring.

20. A dust containment device for mounting on a surfacing machine having a motor mounted upon a top of a body having a larger circumference than the motor, comprising:

a top loop having an adjustable circumference including a maximum circumference and a minimum circumference, wherein the top loop is means for removably coupling about the motor and above the body;

a bottom loop having a circumference greater than the minimum circumference of the top loop, wherein the bottom loop is substantially rigid and is means for encircling the body, and for allowing air to flow between the bottom portion means and the work surface; and a flexible skirt means, coupled between the top loop and the bottom loop, for preventing dust particles from escaping the dust containment device.

* * * * *